US008069967B2

(12) United States Patent
Hino et al.

(10) Patent No.: US 8,069,967 B2
(45) Date of Patent: Dec. 6, 2011

(54) COIN SORTING DEVICE

(75) Inventors: Yushi Hino, Himeji (JP); Shungo Yoshino, Himeji (JP); Yoshikatsu Oota, Himeji (JP); Tatsuya Oonishi, Himeji (JP)

(73) Assignee: Glory Ltd., Hyogo-Ken (JP)

( * ) Notice: Subject to any disclaimer, the term of this patent is extended or adjusted under 35 U.S.C. 154(b) by 169 days.

(21) Appl. No.: 11/992,776

(22) PCT Filed: Sep. 30, 2005

(86) PCT No.: PCT/JP2005/018154

§ 371 (c)(1),
(2), (4) Date: Apr. 27, 2009

(87) PCT Pub. No.: WO2007/043110

PCT Pub. Date: Apr. 19, 2007

(65) Prior Publication Data

US 2009/0215372 A1 Aug. 27, 2009

(51) Int. Cl.
*G07F 1/04* (2006.01)

(52) U.S. Cl. ..... 194/346; 194/344; 453/14; 453/15; 453/29; 453/49; 453/57

(58) Field of Classification Search ..... 194/342–346; 453/1–3, 5–7, 9–15, 18–20, 29, 30, 32–35, 453/39, 40, 49, 56, 57
See application file for complete search history.

(56) References Cited

U.S. PATENT DOCUMENTS 5,997,395 A * 12/1999 Geib et al. ..... 453/10
6,318,537 B1 * 11/2001 Jones et al. ..... 194/346
6,772,870 B2 8/2004 Sugai et al.
6,783,452 B2 8/2004 Hino et al.
6,991,530 B2 1/2006 Hino et al.
7,004,831 B2 2/2006 Hino et al.
2002/0058471 A1 5/2002 Hino et al.
(Continued)

FOREIGN PATENT DOCUMENTS

JP 63-53174 4/1988
(Continued)

OTHER PUBLICATIONS

Translation of WO 2004/109609 A1.*
(Continued)

*Primary Examiner* — Jeffrey Shapiro
(74) *Attorney, Agent, or Firm* — Smith, Gambrell & Russell, LLP

(57) ABSTRACT

A downstream side of a chute associated with at least one sorting hole is branched into a first chute and a second chute, through which coins ejected from the sorting hole are guided into first and second temporary storages, respectively. A route-switching mechanism is also provided that switches, between the two chutes, a route of the coins ejected from the sorting hole. The following control is conducted for the coins of a denomination to be ejected from the sorting hole. (i) Switching the route of the coins ejected from the sorting hole from the first chute to the second chute in appropriate timing to ensure that the last coin ($C_N$) to be received into the first temporary storage enters the first chute, and (ii) controlling an ejection mechanism to eject, among coins following the last coin, all coins that have reached the ejection mechanism (6*a*) earlier that the above route-switching operation.

3 Claims, 12 Drawing Sheets

U.S. PATENT DOCUMENTS

| | | | |
|---|---|---|---|
| 2002/0162724 | A1 | 11/2002 | Hino et al. |
| 2003/0019716 | A1 | 1/2003 | Sugai et al. |
| 2004/0238320 | A1 | 12/2004 | Hino et al. |
| 2004/0259490 | A1 | 12/2004 | Hino et al. |

FOREIGN PATENT DOCUMENTS

| | | |
|---|---|---|
| JP | 2002-92678 | 3/2002 |
| WO | 02/067208 | 8/2002 |
| WO | 2004/109609 | 12/2004 |
| WO | 2005/055158 | 6/2005 |

OTHER PUBLICATIONS

English Translation of International Preliminary Examination Report (Chapter 1) for PCT/JP2005/018154 (PCT Form 373 and 237) with accompanying Notification of Transmittal of same (PCT Form 338) on Apr. 10, 2008.

Supplementary European Search Report dated Aug. 27, 2010 for Application No. EP 05 78 8072.

* cited by examiner

COIN SORTING DEVICE

TECHNICAL FIELD

The present invention relates to a coin sorting device wherein two coin receiving units are assigned to each of at least one sorting structure for ejecting coins of a particular denomination and a route of the coins ejected from the sorting structure can be switched to lead to either of the two receiving units.

BACKGROUND ART

JP2002-92678A (WO02/23493, U.S. Pat. No. 6,783,452) describes a coin sorting system including a presorting device that presorts coins into three groups as a disc rotates. The coin sorting system additionally includes two rectilinear main sorting devices that further sort by respective denominations two of the three coin groups presorted by the presorting device. These main sorting devices each have four sorting structures (sorting holes) each configured to eject coins of a particular denomination. The coins that have been ejected by the respective sorting structures are collected into corresponding coin receiving units (temporary storage) through chutes.

Incidentally, the number of coin denominations varies from currency to currency. For example, the Euro circulates in eight denominations, and US dollars in five denominations (except for rare one-dollar coins). In general, the sizes and circulation volumes of coins also vary according to denominations.

Accordingly, the number of coin receiving units (e.g., eight) is set with one of the currencies largest in the number of denominations (e.g., the Euro) as a reference. If a currency whose number of denominations is smaller than eight (e.g., US dollar) is to be handled, two coin receiving units are assigned to each of at least one sorting structure (e.g., three sorting structures). In this case, two chutes along which the coins ejected from the sorting structure will be guided into the two receiving units are provided to allow coin route switching to either of the two chutes. When the number of coins of a particular denomination (e.g., US 25-cent) that have been collected into one of the two receiving units reaches a previously set number N, the chute (the route of the coins) is switched so that further coins will be collected into the other receiving unit.

In this case, denominations of the coins are discriminated by using a discrimination sensor provided at the coin-introducing side of the sorting device. The last coin to be collected from the sorting structure into one receiving unit (i.e., the N-th coin) and the first coin to be collected into the other receiving unit (i.e., the (N+1)-th coin) are identified on the basis of the discrimination results. It is practically impossible, however, to switch the chute timely between the last coin and the first coin while sorting the coins at high speed. In order to compensate for this inconvenience, therefore, the introduction of coins is temporarily stopped immediately after the last coin has moved past the discrimination sensor, and then the chute is switched before the introduction of the remaining coins is restarted.

DISCLOSURE OF INVENTION

An object of the present invention is to ensure that coin route switching without a stop of introduction of coins, in such a coin sorting device as described earlier herein, is conducted so that when the number of coins which have been collected into one of two receiving units reaches a previously set number, other coins will be collected into the other receiving unit.

To achieve the object, there is provided a coin sorting device, comprising:

a sorting member that includes a1) a coin conveying passageway with an inlet through which coins are introduced one by one, a2) a plurality of sorting structures spacedly arranged along the conveying passageway, each of the sorting structures being configured to eject coins of a particular denomination, a3) a discrimination sensor for discriminating the coins, disposed between the inlet and the upstream-most sorting structure on the conveying passageway, and a4) an ejection mechanism disposed between the discrimination sensor and the upstream-most sorting structure on the conveying passageway, the ejection mechanism being configured to selectively eject the coins;

a conveyor member that conveys the coins along the conveying passageway of the sorting member;

at least one pair of first and second sorted-coin receiving units assigned to one of the sorting structures;

at least one pair of first and second chutes through which the coins ejected from the associated sorting structure are guided into the first and second receiving units in the associated pair of receiving units, respectively;

a route-switching mechanism configured to switch a route of the coins ejected from the sorting structure between the first and second chutes in the pair of chutes; and a control unit configured to discriminate the coins on the basis of outputs from the discrimination sensor, and to control the ejection mechanism and the switching mechanism according to discrimination results thereof, the control unit being further configured, for the coins of denominations to be ejected by the sorting structure associated with the switching mechanism, to:

b1) control the switching mechanism to switch the route of the coins ejected from the associated sorting structure from the first chute to the second chute in appropriate timing to ensure that a last coin as the last one of coins to be received into the first receiving unit enters the first chute; and b2) control the ejection mechanism to eject, among coins following the last coin, all coins that have been reached the ejection mechanism earlier than the route-switching operation of the switching mechanism.

In this coin sorting device, the chute (the route of the coins) can be switched to ensure that when the number of coins which have been collected into the first receiving unit reaches a previously set number, other coins will be collected into the second receiving unit, without stopping the introduction of any coins.

The coin sorting device may further comprise an ejected-coin receiving unit that receives the coins ejected by the ejection mechanism with the coins directly removable to outside the sorting device; wherein the control unit may be further configured to control the ejection mechanism to eject reject coins whose discrimination results based on outputs from the discrimination sensor are abnormal.

In that case, among coins following the last coin, only those which reached the ejector earlier than the route-switching operation of the switching mechanism are collected into an ejected-coin receiving unit applicable to the reject coins as well, and these coins are placed in an appropriate state so as to be directly removable from the common receiving unit to outside the device.

To achieve the object, there is also provided a coin sorting device, comprising:

a sorting member that includes a1) a coin conveying passageway with an inlet thorough which coins are introduced one by one, a2) a plurality of sorting structures spacedly arranged along the conveying passageway, each of the sorting structures being configured to eject coins of a particular denomination, a3) a discrimination sensor for discriminating coins, disposed between the inlet and the upstream-most sorting structure on the conveying passageway, and a4) first and second ejection mechanisms spacedly arranged along the conveying passageway between the discrimination sensor and the upstream-most sorting structure, each of the ejection mechanisms being configured to selectively eject the coins;

a conveyor member that conveys the coins along the conveying passageway of the sorting member;

at least one pair of first and second sorted-coin receiving units assigned to one of the sorting structures;

at least one pair of first and second chutes through which the coins ejected from the associated sorting structure are guided into the first and second receiving units in the associated pair of receiving units, respectively;

a route-switching mechanism configured to switch a route of the coins ejected from the sorting structure between the first and second chutes in the pair of chutes;

a first ejected-coin receiving unit that receives the coins ejected by the first ejection mechanism;

a second ejected-coin receiving unit that receives the coins ejected by the second ejection mechanism; and a control unit configured to discriminate the coins on the basis of outputs from the discrimination sensor, and to control the first and second ejection mechanisms and the switching mechanism according to discrimination results thereof, the control unit being further configured to:

c1) control the first ejection mechanism to eject reject coins whose discrimination results based on outputs from the discrimination sensor are abnormal;

c2) control the second ejection mechanism to eject the coins of a particular denomination according to particular requirements; and c3) for the coins of denominations to be ejected by the sorting structure associated with the switching mechanism, c31) control the switching mechanism to switch the route of the coins ejected from the associated sorting structure from the first chute to the second chute in appropriate timing to ensure that a last coin as the last one of coins to be received into the first receiving unit enters the first chute, and c32) control the first and/or second ejection mechanism to eject, among coins following the last coin, all coins that have been reached the first and/or second ejection mechanism earlier than the route-switching operation of the switching mechanism.

In this coin sorting device, the chute (the route of the coins) can also be switched to ensure that when the number of coins which have been collected into the first receiving unit reaches a previously set number, other coins will be collected into the second receiving unit, without stopping the introduction of any coins. In this case, among coins that follow the last coin, only those which reached the ejector earlier than the route-switching operation of the switching mechanism are collected into the first ejected-coin receiving unit applicable to the reject coins as well, and/or according to needs, into the second ejected-coin receiving unit also applicable to so-called "arbitrarily sorted coins" that are the coins of particular denominations ejected by the second ejector.

BEST MODE FOR CARRYING OUT THE INVENTION

Next, an embodiment of the present invention will be described referring to the accompanying drawings. FIGS. 1 to 12 are diagrams and views showing an embodiment of a coin sorting system based on the present invention.

A total system configuration of the present embodiment, detailed configurations of major sections, basic operation of the system, a configuration and operational sequence associated with route switching, advantageous effects, and modifications are described in order below.

Total System Configuration

Figure 1:
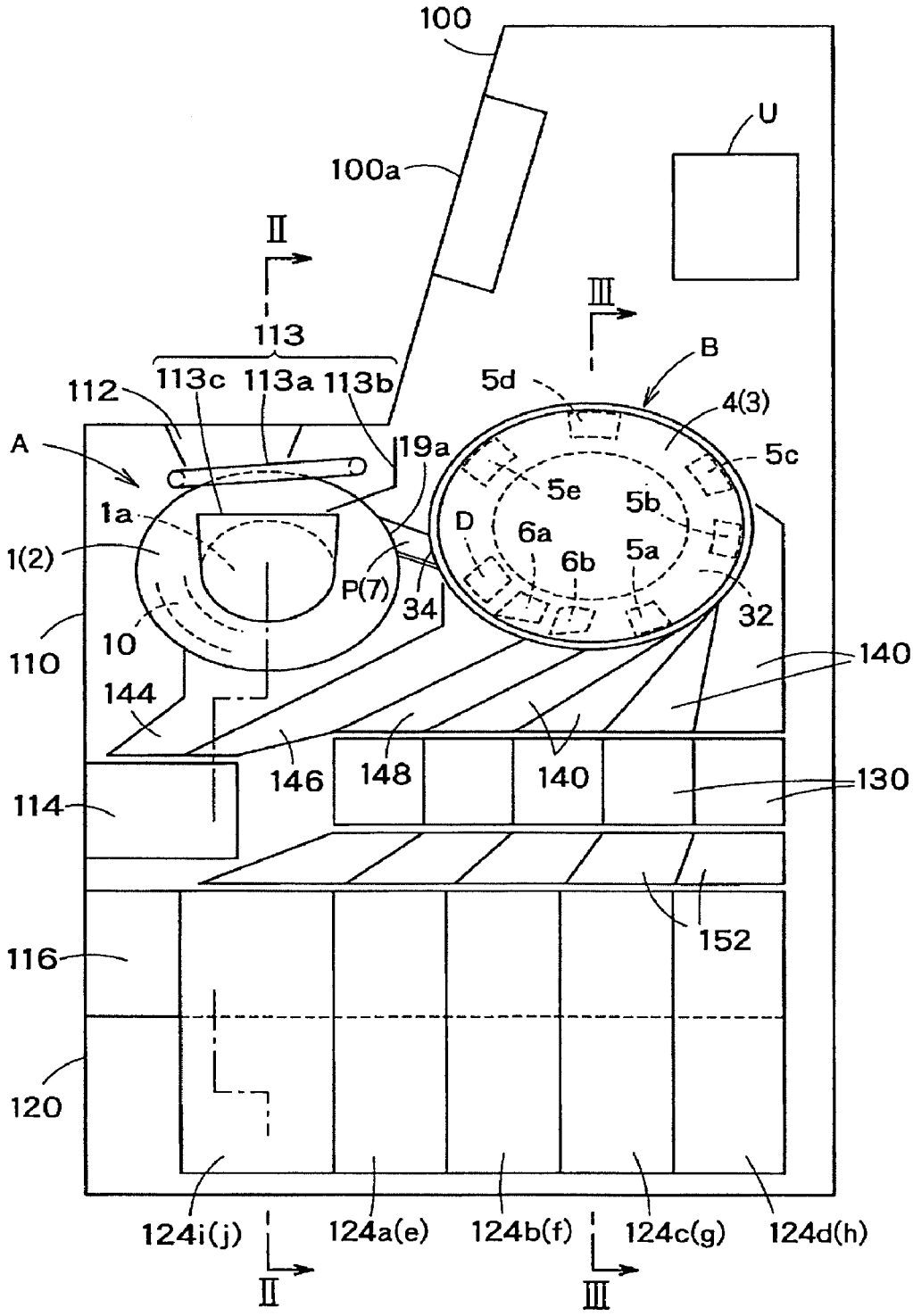
FIG. 1 is a longitudinal sectional view schematically showing an embodiment of a coin sorting system to which the present invention is applied.
Figure 2:
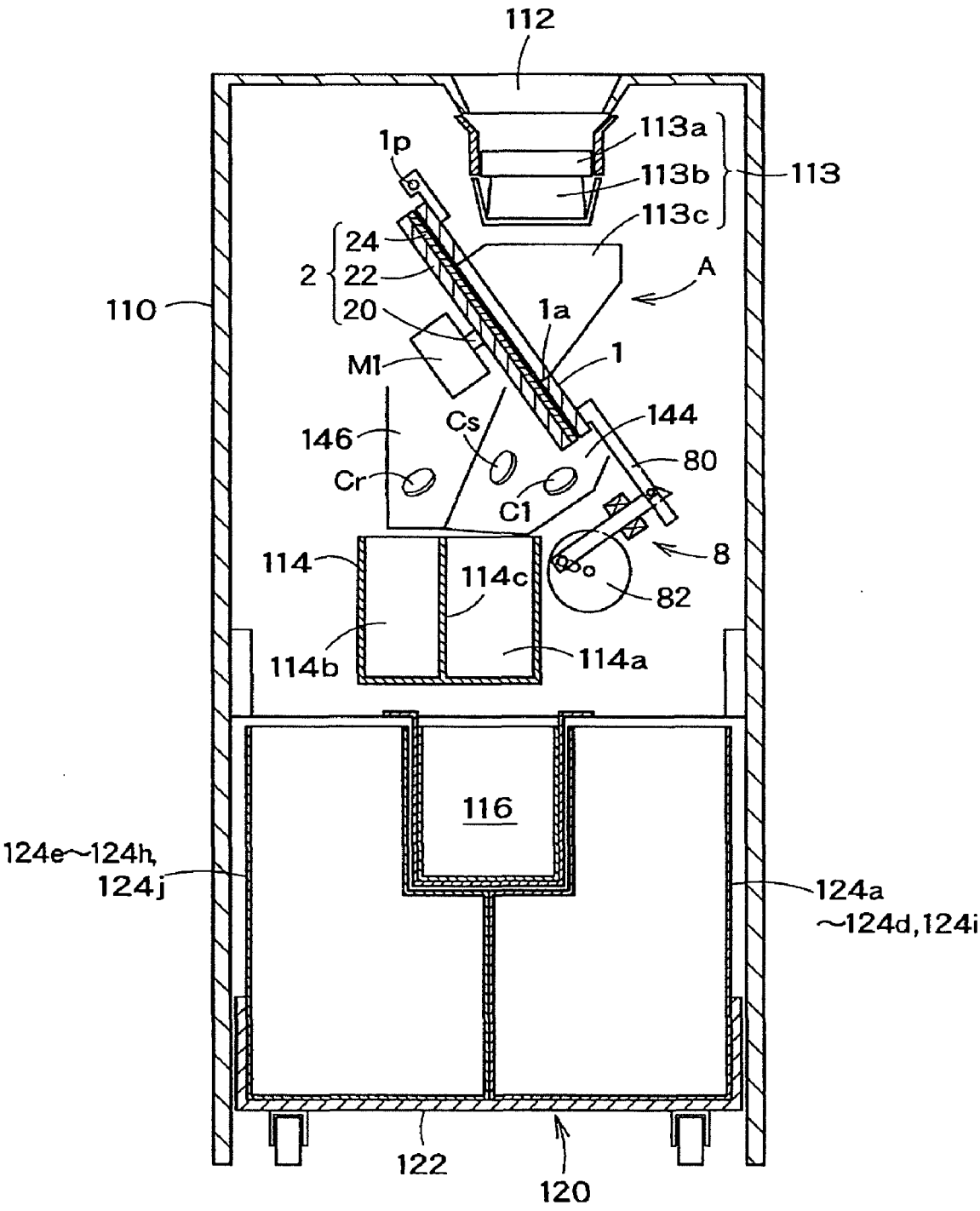
FIG. 2 is a sectional view taken along line II-II of FIG. 1.
Figure 3:
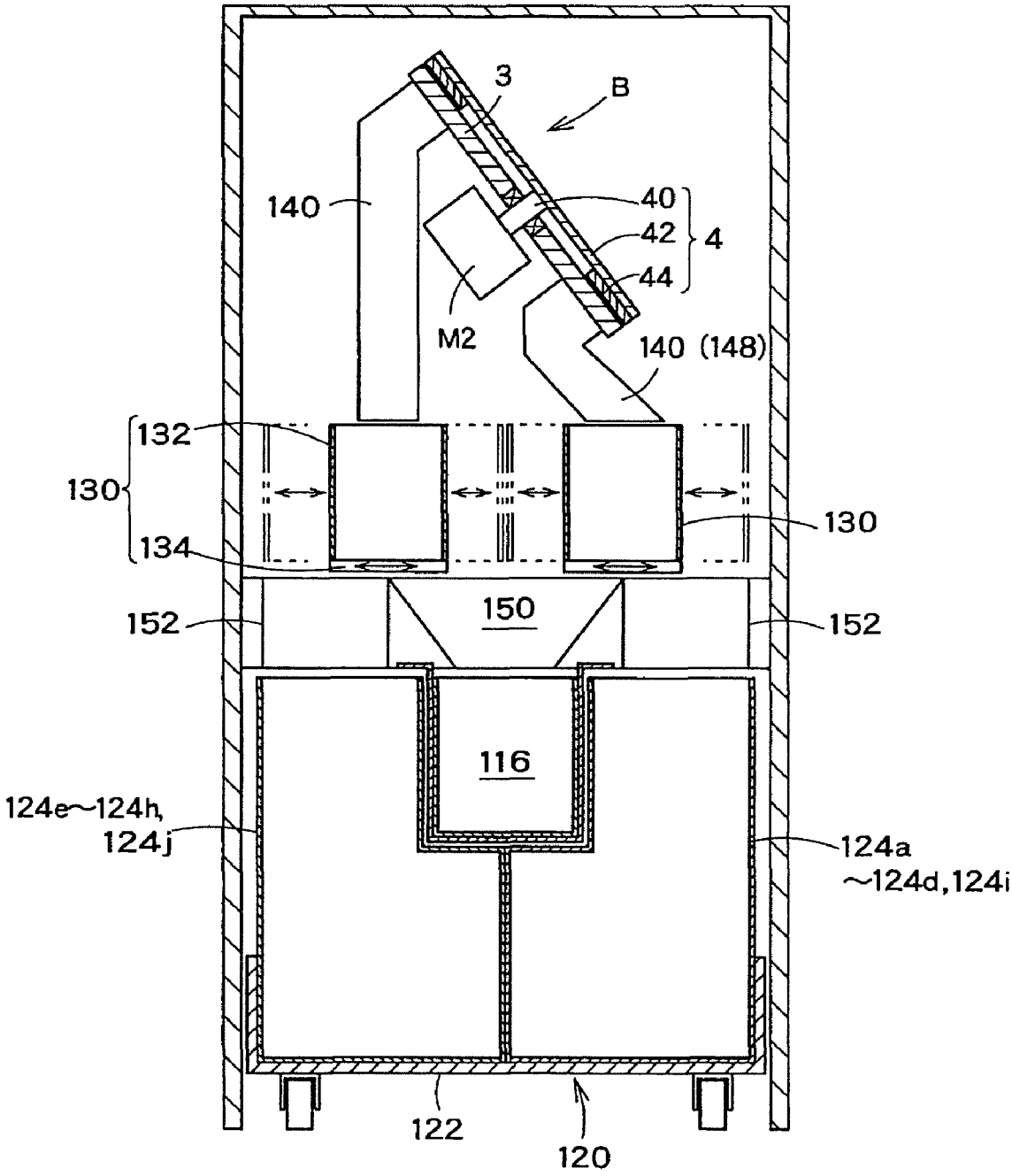
FIG. 3 is a sectional view taken along line III-III of FIG. 1.

As shown in FIGS. 1 to 3, the coin sorting system of the present embodiment has a feed unit A and a sorting unit B, both of which are of a rotary disc type.

The feed unit A shown in FIGS. 1 and 2 has a rotary feed disc 2 and a stationary guide member 1 opposed to the feed disc 2. As shown in FIG. 2, the feed disc 2 has a rotary shaft (axis) 20 inclined relative to a horizontal plane and also has a planar upper face. The guide member 1 has a bottom face opposed to the upper face of the feed disc 2 and also has a coin inlet opening 1*a* formed in the disc in such a form as to extend through a central section of the disc. As shown in FIG. 1, a coin guide passageway 10 with a coin outlet 19*a* from which coins are fed one by one with rotation of the feed disc 2 is formed on the bottom face of the guide member 1.

The sorting unit B shown in FIGS. 1 and 3 has a rotary conveyor disc (conveyor member) 4 and a stationary sorting member 3 opposed to the conveyor disc 4. As shown in FIG. 3, the conveyor disc 4 has a rotary shaft (axis) 40 inclined substantially in parallel to the rotary shaft 20 (see FIG. 2) of the feed disc 2. As shown in FIG. 1, the sorting member 3 is formed with an annular coin-conveying passageway 32 which has an inlet 34 to introduce the coins one by one that have been fed from the coin outlet 19*a*, and through which the coins are conveyed with the rotation of the conveyor disc. A plurality of sorting devices (i.e., first and second ejectors (ejection mechanisms) 6*a* and 6*b*, respectively, and five sorting holes, 5*a* to 5*e*) spacedly arranged along the conveying passageway 32 and each adapted for selectively ejecting the coins are also formed in the sorting member 3.

On the conveying passageway 32 of the sorting member 3, a discrimination sensor D for discriminating the coins is disposed between the inlet 34 and the upstream-most sorting device (first ejector 6*a*). While the discrimination sensor D can be of any of various types such as one which detects materials of the coins electromagnetically, the sensor D used in the present embodiment is an image sensor that recognizes images of the coins, such as an image of a relief shape, or a reflection type of magnetic sensor that recognizes diameters of the coins. This coin sorting system also has a control unit U configured to discriminate the coins on the basis of an output signal from the discrimination sensor D and to control the ejector 6*a*, 6*b*, or other components, depending upon discrimination results thereof. The control unit U also has a function that conducts integrated operational control of the coin sorting system components.

As shown in FIG. 1, a passageway member P is disposed between the feed unit A and the sorting unit B. The passageway member P is formed with a rolling-coin passageway 7 extending aslope to cause the coins to roll from the coin outlet 19*a* of the feed unit A to the inlet 34 of the sorting unit B under the own weights thereof.

Figure 4:
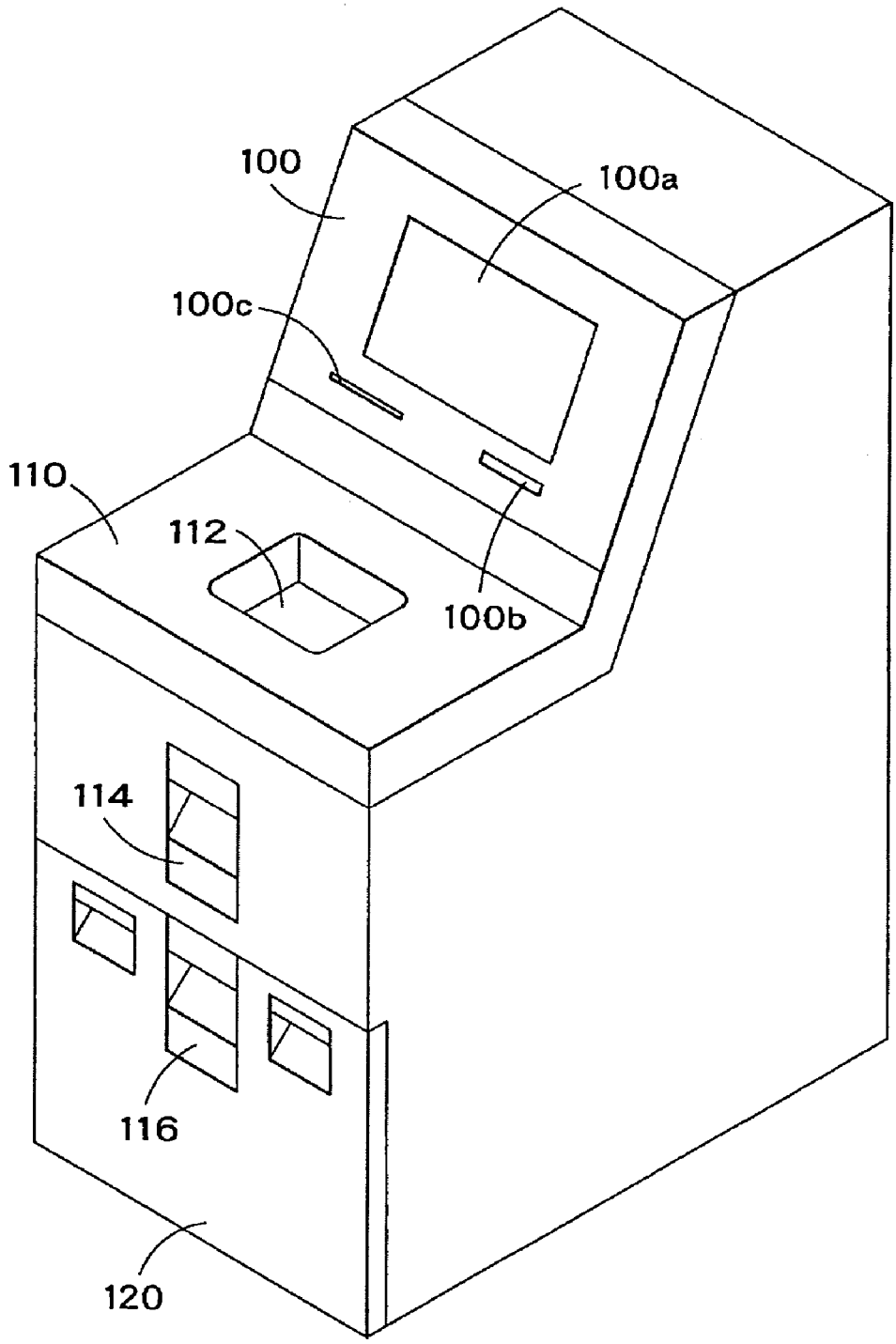
FIG. 4 is an external perspective view of the coin sorting system shown in FIG. 1.

The above feed unit A, sorting unit B, and passageway member P are provided in a coin processing part 110 of the coin sorting system, as shown in FIG. 4. An upward projecting information processing part 100 is provided at upper rear of the coin processing part 110. A display/operating unit 100*a* in the form of a touch-panel display is provided on a front face of the information processing part 100, as shown in FIGS. 1 and 4. As shown in FIG. 4, the front face of the information processing part 100 also has a card insertion slot 100*b* and receipt-issuing slot 100*c* useful when the sorting system is intended for a coin deposit machine.

As shown in FIGS. 1, 2, and 4, an upper face of the coin processing part 110 has a hopper 112 for receiving coins to be processed. As shown in FIGS. 1 and 2, a coin receiving means 113 for introducing coins into the coin inlet opening 1*a* of the feed unit A is provided below the hopper 112. The coin-receiving means 113 includes a conveyor belt 113*a*, a chute 113*b*, and a guide member 113*c*.

Figure 5:
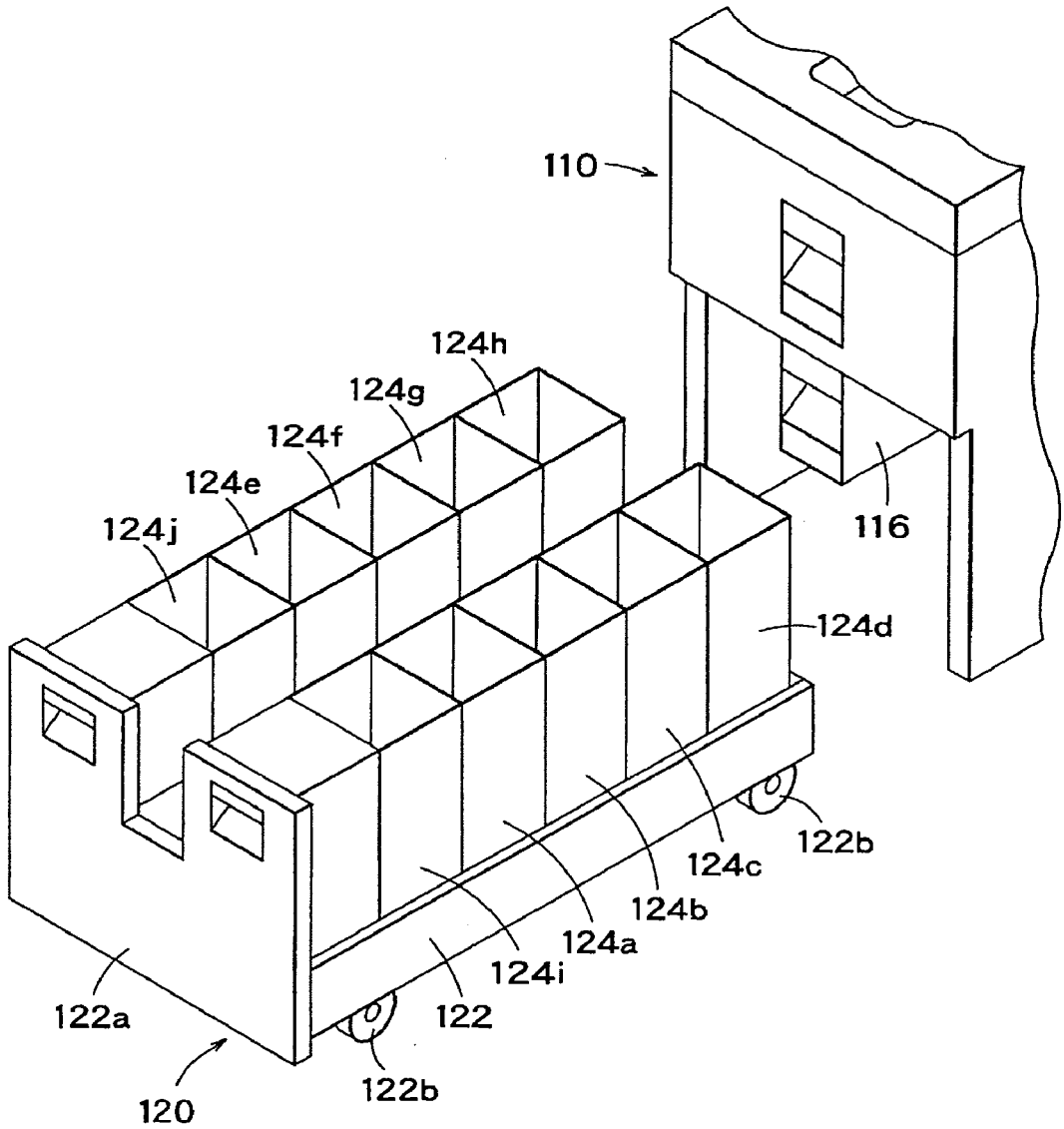
FIG. 5 is a partly enlarged view of a storage unit, showing a pulled-out state of a storage unit in the coin sorting system of FIG. 4.

As shown in FIGS. 1 to 5, the coin processing part 110 further has a reject box 114, a return box 116, and a storage unit 120, each of which is slidable in a forward direction. The storage unit 120 has, as shown in FIGS. 1 to 3 and 5, a plurality of coin storage cassettes 124*a* to 124*j* and a wheeled drawer 122 that removably holds each of the storage cassettes 124*a* to 124*j*. As shown in FIG. 5, the drawer 122 has a front wall 122*a* and four casters 122*b*. The storage unit 120 and the return box 116 are provided independently of each other so as to be pulled out independently.

As shown in FIG. 1, chutes 140 corresponding to the respective sorting holes 5*a* to 5*e* and the second ejector 6*b* of the sorting unit B each extends substantially downward. In addition, as shown in FIGS. 1 and 3, temporary storages 130 each for temporarily storing coins are installed at their appropriate position near the respective lower ends of the corresponding chutes 140. A returning passageway 150 communicating with the return box 116, and storage passageways 152 and 152 communicating with the corresponding coin storage cassettes 124*a* to 124*d* and 124*i*; 124*e* to 124*h* and 124*j*, respectively, are provided below the storages 130.

Each temporary storage 130 has a tubular main body 132 and a bottom plate 134 blocking the bottom of the main body 132. Each storage 130 is constructed so that if width of the storage is taken as one pitch, the main body 132 and the bottom plate 134 can be moved in half-pitch steps in opposite lateral directions. This permits each storage 130 to fully open at the bottom thereof when the main body 132 is moved to a position above the passageway 150 or 152. A driving system (not shown) is provided that implements such movements of each storage 130.

As shown in FIGS. 1 and 2, a chute 144 extending in a forwardly downward direction is provided at an appropriate position for the feed unit A and the passageway member P. Also, a chute 146 extending substantially in parallel to the chute 144 is provided at an appropriate position for the first ejector 6*a* in the sorting unit B. As shown in FIG. 2, the reject box 114 is internally separated into a first compartment 114*a* and a second compartment 114*b* by a partition 114*c*. Lower ends of the chutes 144 and 146 are opened above the first compartment 114*a* and second compartment 114*b*, respectively, of the reject box 114.

Detailed Configurations of Major Sections

Next, further detailed configurations of the above-described feed unit A, passageway member P, and sorting unit B are described below as items (1), (2), and (3), respectively.

(1) Feed Unit A

As shown in FIG. 2, the rotary feed disc 2 of the feed unit A has a disc body 22 and a resilient member 24 covering an upper face of the body 22. The disc body 22 is coupled to a motor M1 via the rotary shaft 20. The resilient member 24 is constructed of, for example, a resilient sheet material such as urethane rubber and has a planar surface. The resilient member 24 is configured to hold coins present in a space (gap) between the resilient member and the stationary guide member 1, and to absorb differences in thickness between coins of different denominations as well as changes in the above space. Thus, the coins that have been introduced from the inlet opening 1*a* of the guide member 1 into the space between the feed disc 2 and the guide member 1 slide with respect to the bottom of the guide member 1 as the disc 2 rotates.

Figure 6:
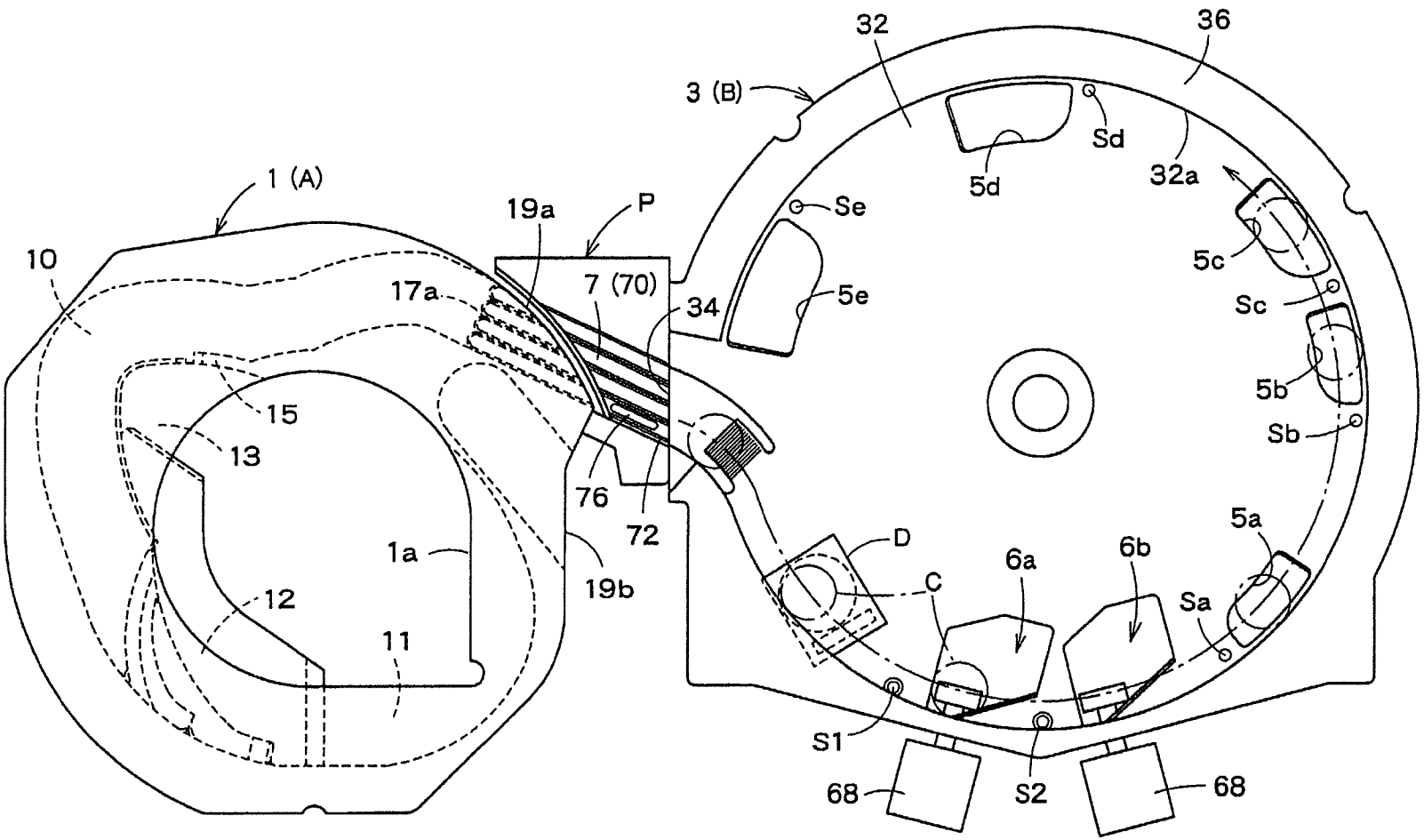
FIG. 6 is a view of a stationary guide member of a feed unit, a stationary sorting member of a sorting unit, and a passageway member, this view showing the three members as seen from a direction of a rotary axis of each unit in the coin sorting system of FIG. 1.
Figure 7:
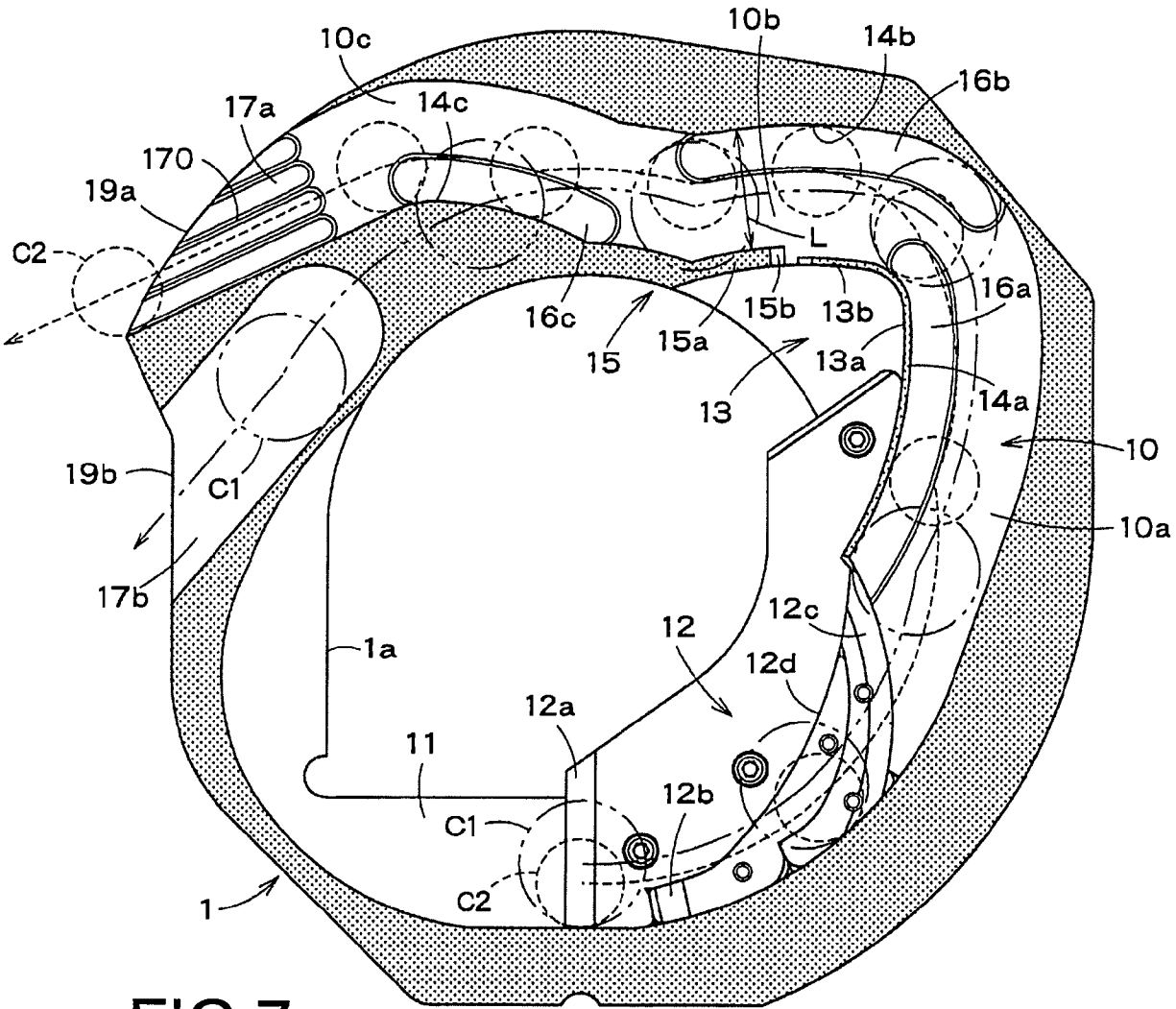
FIG. 7 is a rear view of the stationary sorting member shown in FIG. 6.

As shown in FIGS. 6 and 7, a bottom face 1*b* (FIG. 7) of the stationary guide member 1 is formed with a coin entrance (coin-introducing section) 11 facing a lower section of the inlet opening 1*a*, and the coin guide passageway 10 that selectively guides the coins introduced from the inlet opening 1*a* through the entrance 11 and sliding with respect to the bottom face 1*b*. The entrance 11 is formed so that a space (gap) between this section and the resilient member 24 (FIG. 2) of the disc 2 is larger than a thickness of the thickest coin. The guide passageway 10 is formed so as to selectively guide according to diameter the coins sliding with respect to the bottom face 1*b* of the stationary guide member 1.

An overlapping-state release structure 12 for releasing an overlapping state of coins and ensuring single-tier single-file coin transfer in the coin passageway 10 is disposed between the guide passageway 10 and the entrance 11. As shown in FIG. 7, the release structure 12 has three stairs 12*a*, 12*b*, and 12*c* arranged at intervals. The middle step 12*b* is narrower than the other stairs 12*a* and 12*c* and formed at a position offset in a radial outward direction of the guide member 1. The release structure 12 also has an outer edge 12*d* extending from the step 12*b* towards the step 12*c* at a downstream side and curved to approach a central section of the guide member 1. The presence of the outer edge 12*d* makes it possible to return, in a direction of the inlet opening 1*a*, coins that are not fully shifted in the radial outward direction of the guide member 1.

The guide passageway 10 is, from an upstream side (release structure 12) towards a downstream side thereof, divided into a first passageway 10*a*, a second passageway 10*b*, and a third passageway 10*c* in that order. The guide passageway 10 is curved so that as it goes towards the downstream side, the guide passageway steers further away from the center of the guide member 1 at the first passageway 10*a*, then becomes closer to the center of the guide member 1 at the second passageway 10*b*, and once again steers further away from the center of the guide member 1 at the third passageway 10*c*. The passageways 10*a*, 10*b*, and 10*c* are formed with an inner edge 14*a*, an outer edge 14*b*, and another inner edge 14*c*, respectively, each of which guides a coin by making an edge thereof abut upon the edge. In order to allow for deformed or other coins, recesses 16*a*, 16*b*, and 16*c* for making the edge of the coin more reliably abut upon the respective edges 14*a*, 14*b*, and 14*c* are also formed in each of the passageways 10*a*, 10*b*, and 10*c*.

An overlapping-coin returning structure 13 is provided on radial inner side of the first passageway 10*a* and the second passageway 10*b*. The returning structure 13 is provided to return any coins that may have moved past the overlapping-state release structure 12 in an overlapping condition. The returning structure 13 has an upstream-side step 13*a* defining the inner edge 14*a* of the first passageway 10*a* and a downstream-side step 13*b* positioned on radial inner side of the second passageway 10*b*. The upstream-side step 13*a* is formed to have a surface lower than thickness of the thinnest coin and is adapted so that, of two overlapping coins, only the coin closer to the disc 2 (FIG. 2) will pass through towards the inlet opening 1*a*. Also, the downstream-side step 13*b* guides, along an inner edge thereof, the coin that has moved past the upstream-side step 13*a* and returns the coin in a direction of the inlet opening 1*a*.

A large-coin sorting section 15 for sorting out, among coins passing through the coin passageway 10, only large coins C1 each having a diameter greater than a reference dimension L is provided on radial inner side of the second passageway 10*b* and the third passageway 10*c*. The sorting section 15 assumes use of such large coins C1 as US 50-cent coins that do not even need to be sorted out since these coins are not easy to handle because of their large sizes and since these coins are thus very small in circulation volume. The sorting section 15 has a step 15*a* formed so that the respective peripheral areas of only large coins C1 run onto the step 15*a*. More specifically, the sorting section 15 is constructed so that the coins that pass through the second passageway 10*b* reach the sorting section 15 with an edge of each such coin remaining abutted upon the outer edge 14*b* of the second passageway 10*b*. A distance between the outer edge 14*b* of the second passageway 10*b* and the step 15*a* is set to equal the above reference dimension L. An upstream end of the step 15*a* has a slope 15*b* for assisting the coin in running onto the step 15*a*.

Also, a large-coin passageway 17*b* is formed downstream of the sorting section 15 to accept the coin that has run onto the step 15*a* and has slidingly been fed in along the bottom face 1*b* and to guide the coin in a direction substantially tangent to the feed disc 2. The passageway 17*b* has an ejection outlet 19*b* trough which the large coins C1 are ejected to outside the guide member 1. The above sorting section 15, passageway 17*b*, and ejection outlet 19*b* constitute a large-coin ejection structure that sorts out, among coins passing through the coin passageway 10, only large coins C1 whose diameters are greater than the above reference dimension L and ejects the same sorted coins.

Small coins C2 each having a diameter equal to or less than the reference dimension L do not get on the step 15*a* of the sorting section 15. Instead, these coins move past the step 15*a* and enter the third passageway 10*c*. The small coins C2 that have entered the third passageway 10*c* move downstream along the inner edge 14*c* of the third passageway 10*c*. A small-coin passageway 17*a* is continuously formed at the downstream of the third passageway 10*c*. The passageway 17*a* has the coin outlet 19*a* thorough which the small coins C2 are moved out to outside the guide member 1, in the direction substantially tangent to the feed disc 2. The passageway 17*a* is formed with three ridges 170 each extending in an extending direction of the passageway and arranged at substantially equal intervals.

As shown in FIG. 2, the guide member 1 is arranged to swing with respect to the feed disc 2 about an axis 1*p* disposed near an upper section of the disc 2. The axis 1*p*, although preferably disposed substantially in parallel to the feed disc 2, is typically disposed substantially in parallel to the disc 2 and horizontally. A separator 8 that swings the guide member 1 by lifting a lower section thereof to temporarily separate the member 1 from the feed disc 2 is also provided. The separator 8 has a lever 80 connected to a lower end of the guide member 1 and also has a motor-driven oscillating block slider-crank mechanism 82 coupled to a distal end of the lever 80.

(2) Passageway Member

Figure 8:
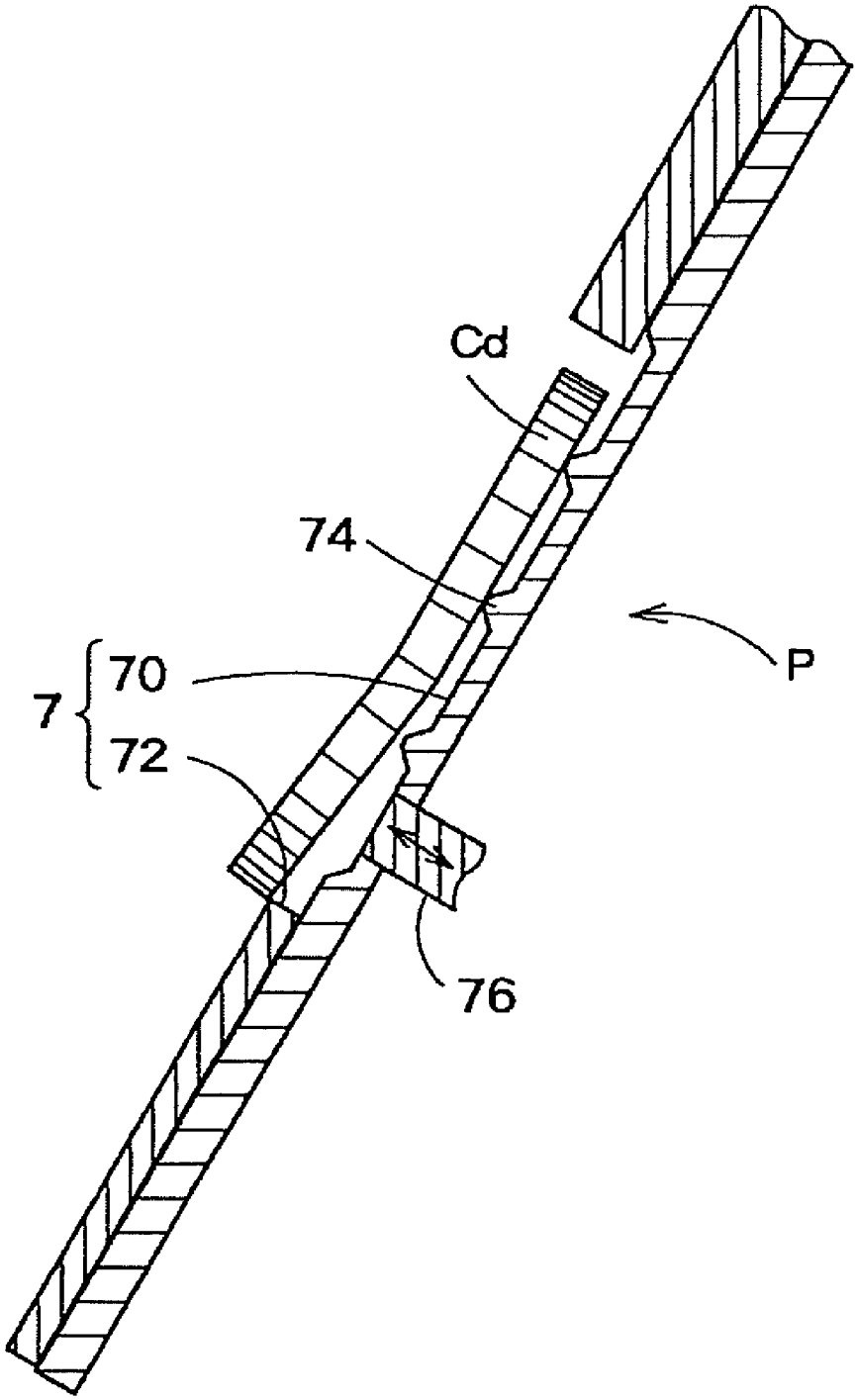
FIG. 8 is a transverse sectional view showing the passageway member of FIG. 6 together with a deformed coin.

The passageway member P shown in FIGS. 6 and 8 has a shape of a substantially flat plate, on a surface of which the rolling-coin passageway 7 is formed. The rolling-coin passageway 7 is defined by a wall surface 70 that slidably supports the bottom face of a coin fed in a rolling condition and a ledge surface 72 that supports the edge of the coin. The wall surface 70 of the passageway 7 is formed on the passageway member P in a form substantially orthogonal to the rotary shaft 20 (FIG. 2) of the feed disc 2 and the rotary shaft 40 (FIG. 3) of the conveyor disc 4, that is, substantially in parallel to the discs 2 and 4 themselves. The ledge surface 72 of the passageway 7 is formed on the passageway member P to extend along a lower edge of the wall surface 70 and to extend in a direction substantially orthogonal thereto. At least a part (e.g., a downstream part) of the ledge surface 72 extends with a length substantially equal to or less than a dimension equivalent to a thickness of the thinnest coins in the direction substantially orthogonal to the wall surface 70.

As shown in FIG. 6, the ledge surface 72 rectilinearly extends in downward inclined form from the coin outlet 19*a* of the feed unit A to the inlet 34 of the sorting unit B. An extending direction of the ledge surface 72 substantially agrees with that of the small-coin passageway 17*a* in the feed unit A. As shown in FIG. 8, three ridges 74 each parallel to the ledge surface 72 are formed on the wall surface 70. The ridges 74 are arranged almost on an extension line of the three ridges 170 (FIG. 7) formed on the small-coin passageway 17*a*.

Because of the above-described construction of the rolling-coin passageway 7, each small coin C2 that has been fed from the coin outlet 19*a* of the feed unit A rolls to the inlet 34 of the sorting unit B under the own weight of the coin with the bottom face and the edge thereof supported by the wall surface 70 (ridges 74) and the ledge surface 72, respectively. A coin Cd (FIG. 8) that is deformed to such an extent that an edge thereof deviates from the ledge surface 72 during rolling along the rolling-coin passageway 7 is not supported by the ledge surface 72 and therefore slides down from the passageway 7.

An ejector 76 is disposed between the lowermost ridge 74 on the wall surface 70 and the ledge surface 72. The ejector 76 is arranged to move thorough the passageway member P to protrude from/retract into the wall surface 70. For example, if the coin stalls in the rolling-coin passageway 7, the ejector 76 is temporarily protruded to slide the stalled coin down from the passageway 7, thus rendering the coin removable.

(3) Sorting Unit

As shown in FIG. 3, the rotary conveyor disc 4 of the sorting unit B has a disc body 42 and an annular resilient member 44 covering a peripheral lower surface of the body 42. The disc body 42 is coupled to a motor M2 via a rotary shaft 40 penetrating the stationary sorting member 3. The resilient member 44 is constructed as, for example, a resilient sheet material such as urethane rubber and has a planar surface. The resilient member 44 is configured to hold coins present in a space (gap) between the resilient member 44 and the sorting member 3 and to absorb differences in thickness between coins of different denominations. Thus, the coins that have been introduced from the coin inlet opening 34 of the sorting member 3 into the space between the conveyor disc 4 and the sorting member 3 slide with respect to the upper surface of the sorting member 3 as the disc 4 rotates.

As shown in FIG. 6, the conveying passageway 32 formed on the surface 30 of the sorting member 3 has an outer edge 32*a* defined by an annular member 36. At the same time that the coins passing through the conveying passageway 32 enter the space between the conveyor disc 4 and the sorting member 3 from the inlet 34, the coins are each held by the resilient member 44 of the disc 4 and conveyed with the edge abutted upon the outer edge 32*a* of the conveying passageway 32. At this time, the centrifugal force exerted upon the coin also acts favorably to keep the edge of the coin abutted upon the outer edge 32*a* of the conveying passageway 32. The sorting devices 6*a* and 6*b;* 5*a* to 5*e* arranged downstream of the discrimination sensor D along the conveying passageway 32 are broadly divided into the five sorting holes (sorting sections) 5*a* to 5*e* each configured to eject coins of a particular denomination, and the first and second ejectors 6*a* and 6*b* each configured to selectively eject coins.

The sorting holes 5*a* to 5*e* are formed trough the sorting member 3, and are dimensionally differs from one another according to the respective diameters of coins to be sorted out. In this case, an outer edge of each sorting hole 5*a* to 5*e* is slightly distant from the outer edge 32*a* of the conveying passageway 32. An inner edge of each sorting hole, opposed to the outer edge thereof, is distant from the outer edge 32*a* of the conveying passageway 32 by a distance slightly greater than the diameter of a coin to be sorted out, and smaller than the diameter of a coin larger than the coin to be sorted out. That is to say, each sorting hole 5*a* to 5*e* is configured to drop down only the coin to be sorted out and move larger coins across the sorting hole.

For this purpose, the sorting holes 5*a* to 5*e* are arranged in order from an upstream side of the conveying passageway 32 so as to sort coins in normal ascending order of the diameter. For example, the sorting holes 5*a*, 5*b*, 5*c*, 5*d*, and 5*e* are each configured to sort out (drop down) only US 10-cent, 1-cent, 5-cent, 25-cent, and 1-dollar coins, in that order. Sensors Sa to Se for confirming the movements of coins across the sorting holes 5*a* to 5*e*, respectively, are provided immediately before the respective sorting holes (in terms of the coin flow). Signals from the sensors Sa to Se are input to the control unit U shown in FIG. 1.

Next, further detailed configurations of the first and second ejectors 6*a* and 6*b*, respectively, are described below with reference made principally to FIGS. 9 and 10. Since the ejectors 6*a* and 6*b* both have the same configuration, both are hereinafter referred to collectively as the "ejector 6*a*, 6*b*", with reference symbol 6*a*, 6*b* shown together in FIGS. 9 and 10.

Figure 9:
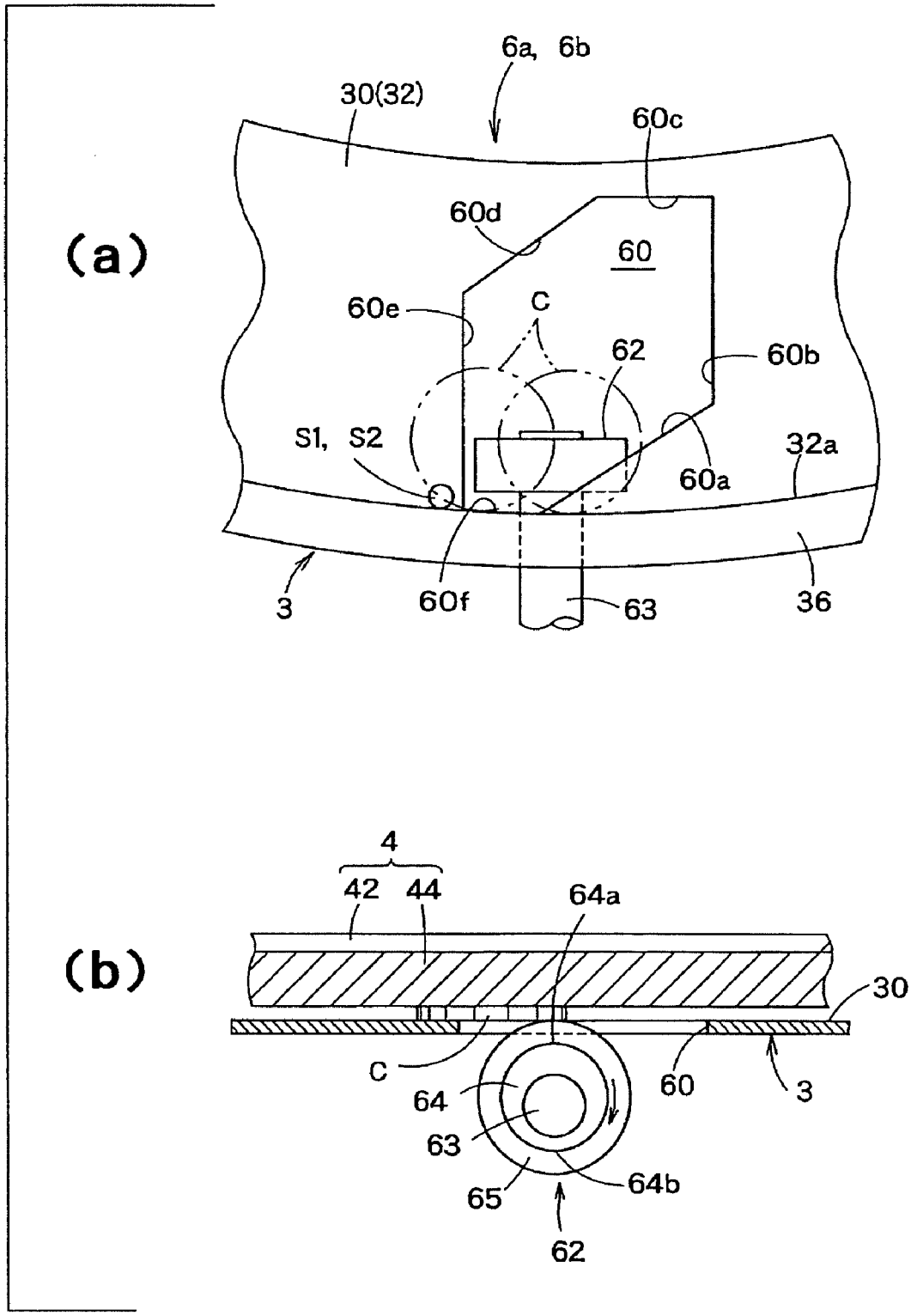
FIG. 9 shows in enlarged form an ejector at the time of coin passage therethrough in the stationary sorting member of FIG. 6, (a) being an associated plan view of the ejector and (b) being an associated longitudinal sectional view thereof.
Figure 10:
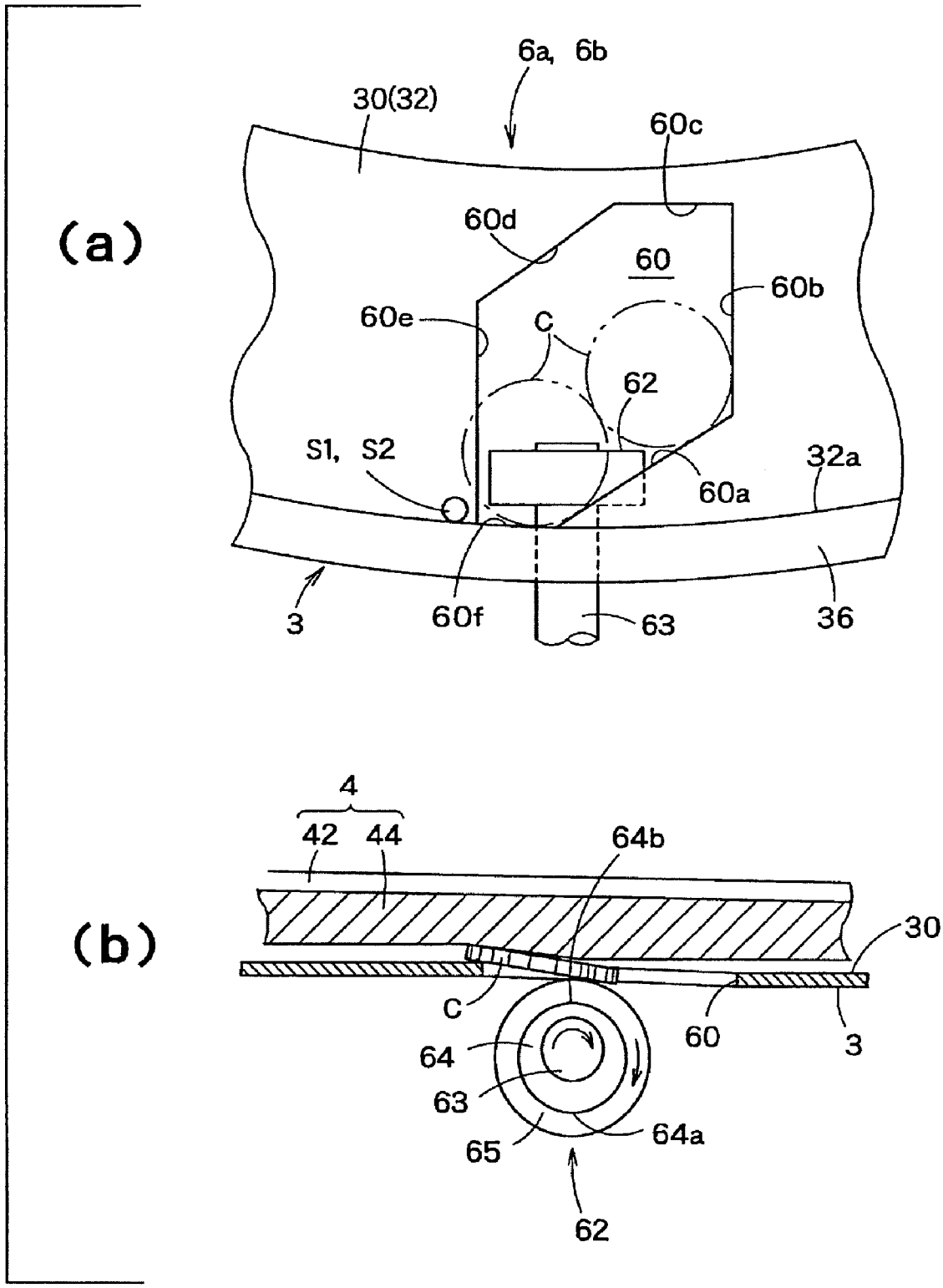
FIG. 10 shows in enlarged form the ejector at the time of coin ejection therefrom in the stationary guide member of FIG. 6, (a) being an associated plan view of the ejector and (b) being an associated longitudinal sectional view thereof.

The ejector 6*a*, 6*b* in FIGS. 9 and 10 has an ejection hole 60 formed trough the sorting member 3 and a support roller member 62 provided under the ejection hole 60. The ejection hole 60 assumes a hexagonal shape having a guide edge 60*a*, a downstream edge 60*b*, an outer edge 60*c*, an opposed edge 60*d*, an upstream edge 60*e*, and an inner edge 60*f*. The edges 60*a* to 60*f* are arranged so that the guide edge 60*a* and the opposed edge 60*d* are parallel to each other, the downstream edge 60*b* and the upstream edge 60*e* are parallel to each other, and the outer edge 60*c* and the inner edge 60*f* are parallel to each other. The guide edge 60*a* linearly extends at an inclination angle of about 30 degrees inward from the annular member 36, towards the downstream side of the conveying passageway 32, at the surface 30 of the sorting member. The inner edge 60*f* is disposed flush with the outer edge 32*a* of the conveying passageway 32 that is defined by the annular member 36.

As also shown in FIG. 6, sensors S1 and S2 for respectively detecting the arrival of a coin at the sensor and confirming the passage of the coin are provided immediately before the upstream edge 60*e* of the ejection hole 60 in the ejector 6*a*, 6*b*. Signals from the sensors S1 and S2 are also input to the control unit U (FIG. 1).

The support roller member 62 has a support shaft 63, an eccentric bearing 64, and a free roller 65. The support roller member 62 is configured to be switchable to either a "coin passage position" at which height of an upper edge of the roller member becomes equal to or higher than a height of an upper end of the guide edge 60*a* of the ejection hole 60 (i.e., the surface 30 of the sorting member 3) or a "coin ejection position" at which the height of the upper edge of the roller member becomes lower than the height of the upper end of the guide edge 60*a* of the ejection hole 60.

More specifically, the eccentric bearing 64 fixed to the support shaft 63 is configured to be pivotally moved by a stepping motor 68 (FIG. 6) that is controlled by the control unit U (FIG. 1). When a larger-radius section 64*a* of the eccentric bearing 64 is directed upward by the pivotal movement of the bearing, the support roller member 62 takes up the "coin passage position" (FIG. 9); when a smaller-radius section 64*b* of the eccentric bearing 64 is directed upward by the pivotal movement of the bearing, the support roller member 62 takes up the "coin ejection position" (FIG. 10). The free roller 65 is mounted for free rotation on an outer peripheral section of the eccentric bearing 64. The free roller 65 is constructed so that at the "coin passage position" (FIG. 9), the free roller can freely rotate while holding a coin C between the roller and the resilient member 44 of the conveyor disc 4.

If discrimination results by the sensor D (FIG. 6) indicate that the ejector 6*a*, 6*b* is to eject the coin (e.g., a reject coin whose discrimination results are abnormal), the corresponding coin is ejected in the sequence below. First, a discrimination result signal is input from the sensor D to the control unit U (FIG. 1). Next after the sensor S1 and S2 have detected the arrival of the coin C, an appropriate detection signal is input to the control unit U; then, the control unit U transmits a driving signal to the stepping motor 68 (FIG. 6) to switch the support roller member 62 to the "coin ejection position" (FIG. 10). Usually, after an elapse of a time required for the coin C to leave the surface of the support roller member 62, the control unit U transmits a driving signal to the stepping motor 68 to switch the support roller member 62 to the "coin passage position" (FIG. 9).

Basic Operation

Next, basic operation or actions of the present embodiment constructed above are described below in a form broadly classified into independent factors associated with (1) the feed unit A and (2) the sorting unit B each. Description of the operation or actions evident from the above construction is omitted as appropriate.

(1) Operation Associated with the Feed Unit

After coins have been loaded into the hopper 112 shown in FIGS. 1, 2, and 4, the coins are introduced into the coin inlet opening 1*a* of the feed unit A by the coin receiving means 113 shown in FIGS. 1 and 2. More specifically, after the coins loaded into the hopper 112 have been conveyed to the chute 113*b* by the conveyor belt 113*a*, the coins are guided and introduced into the coin inlet opening 1*a* under their own weights by means of the chute 113*b* and the guide member 113*c*.

In FIG. 7, coins (large coins C1 and small coins C2) that have entered the coin inlet opening 1*a* are each introduced from the coin-entrance 11 into the space between the guide member 1 and the feed disc 2 (FIG. 2) by the centrifugal force due to the rotation of the disc 2 and by the own weight of the coin. As the feed disc 2 rotates, the thus-introduced coins move past the overlapping-state release structure 12 and enter the first passageway 10*a* of the coin passageway 10.

The coins move trough the first passageway 10*a* with the edges of the coins abutted upon the inner edge 14*a* of the passageway. If these coins include those which have moved past the release structure 12 in overlapping form, only overlapping coins present near the feed disc (FIG. 2) at that time are returned to the coin inlet opening 1*a* by the overlapping-coin returning structure 13.

Next, the coins that have moved from the first passageway 10*a* into the second passageway 10*b* further move on with the edges of the coins abutted upon the outer edge 14*b* of the passageway 10*b*. Among all coins that have thus passed through the second passageway 10*b* and reached the step 15*a* at the sorting section 15, only the large coins C1 that have run onto the step 15*a* are passed through the large-coin passageway 17*b* and ejected from the outlet 19*b*.

In the meantime, the small coins C2 that have not run onto the step 15*a* are allowed to pass through the sorting section 15 into the third passageway 10*c*. The small coins C2 that have entered the third passageway 10*c* further move on with their edges abutted upon the inner edge 14*c* of the passageway. Thus, the small coins C2 that have moved on to steer away from an orbit of the large coins C1 as the coins C2 moved downstream along the third passageway 10*c* enter the small-coin passageway 17*a* and are fed from the outlet 19*a*.

The own weight of each small coin C2 fed from the outlet 19*a* causes the coin to roll towards the inlet 34 (FIG. 6) of the sorting unit B along the rolling-coin passageway 7 of the passageway member P shown in FIGS. 6 and 8. The coin Cd (FIG. 8) that is deformed to such an extent that the edge thereof deviates from the ledge surface 72 during rolling along the rolling-coin passageway 7 is not supported by the ledge surface 72 and therefore slides down from the passageway 7. The coin that has been ejected by the ejector 76 also slides down from the rolling-coin passageway 7.

The large coins C1 (FIG. 2) that have been ejected from the ejection outlet 19*b* (FIGS. 6 and 7) of the feed unit A and the slid-down coins Cs (FIG. 2) that have slid down from the rolling-coin passageway 7 are collected into the first compartment 114*a* (FIG. 2) of the reject box 114 through the chute 114 (FIGS. 1 and 2).

(2) Operation Associated with the Sorting Unit

In FIG. 6, the coins that have rolled under their own weights along the rolling-coin passageway 7 of the passageway member P are introduced one by one from the inlet 34 of the sorting unit B into a space between the sorting member 3 and the conveyor disc 4 (FIG. 3). As the conveyor disc 4 rotates, the introduced coins C are conveyed along the outer edge 32*a* of the conveying passageway 32. The coins conveyed along the conveying passageway 32 first move past the discrimination sensor D and are subjected to discrimination of denominations.

Reject coins whose discrimination results are abnormal are ejected by the first ejector 6*a*. Also, coins of particular denominations are ejected by the second ejector 6*b* as required. For example, coins not to be sorted with the sorting holes 5*a* to 5*e* and coins of denominations corresponding to any storage cassettes 124*a* to 124*h* that may have become full (so-called overflow coins) are assumed as such coins of particular denominations (i.e., coins to be arbitrarily sorted out). The coins that have passed the first and second ejectors 6*a* and 6*b*, respectively, are sorted by dropping from the associated sorting holes 5*a* to 5*e* corresponding to their respective denomination.

Detailed operation or actions of the ejectors 6*a* and 6*b* are described below with reference made to FIGS. 9 and 10.

(i) When the support roller member 62 is at the "coin passage position" (FIG. 9), a coin C that has been conveyed along the outer edge 32*a* of the conveying passageway 32 by the feed disc 4 is held at the ejection hole 60 in a sandwiched condition between the upper edge of the support roller member 62 and the feed disc 4 and moves across the hole 60 without dropping thereinto.

(ii) When the support roller member 62 is at the "coin ejection position" (FIG. 10), another coin C that has been conveyed similarly to the above coin C sinks into the ejection hole 60 to ride on the upper end of the roller member 62, and abuts at an edge of the coin upon the guide edge 60*a* of the ejection hole 60. Next, this coin C is guided by the guide edge 60*a* and moves to deviate from the outer edge 32*a* as the coin moves downstream of the conveying passageway 32. Thus, the coin C moves away from the upper end of the support roller member 62 in an obliquely transverse direction and is ejected by dropping through the ejection hole 60.

As shown in FIGS. 1 and 2, the reject coins (ejected coins) Cr (FIG. 2) that have been ejected by the first ejector 6*a* (FIG. 1) is collected into the second compartment 114*b* (FIG. 2) of the reject box 114 through the chute 146. In addition, as shown in FIGS. 1 and 3, the coins that have been sorted out by the respective sorting holes 5*a* to 5*e* and the second ejector 6*b* (FIG. 1) are collected into the associated temporary storages 130 through the chutes 140 and 148 and temporarily stored in the storages 130.

The coins that have been temporarily stored in each storage 130 are moved to be stored into the associated storage cassettes 124*a* to 124*j* according to, for example, particular amount-confirming operations (or the like) with the display/operating unit 100*a* (FIGS. 1 and 4). If the coins that have been temporarily stored in each storage 130 include coins that need returning for reasons such as mismatching in the confirmed amount, these coins are transferred from the storages 130 to the return box 116 by returning operations with the display/operating unit 100*a*.

As described above, each of the temporary storages 130 (the first and second sorted-coin receiving units/second ejected-coin receiving unit) only has a function that transfers the received coins to the storage cassettes 124*a* to 124*j* or the return box 116 after placing these coins on temporary hold. Therefore, each of the storage boxes does not have a function "receiving coins with the coins directly removable to outside the system (device)." In contrast, the reject box 114 (the first ejected-coin receiving unit) allow received coins to be removed just by pulling the box out to the front and therefore has a function "receiving coins with the coins directly removable to outside the system (device)."

Configuration and Operation Associated with Route Switching

In the present embodiment, one pair of temporary storages 130, 130 (i.e., one pair of the first and second sorted-coin receiving units) are assigned to each of at least one of the sorting holes 5*a* to 5*e* of the sorting unit B in FIG. 1. An example in which a pair of the first and second storages 130 and 130 (associated with, for example, the storage cassettes 124*g* and 124*h*, respectively) are assigned to one sorting hole 5*c* is described below.

Figure 11:
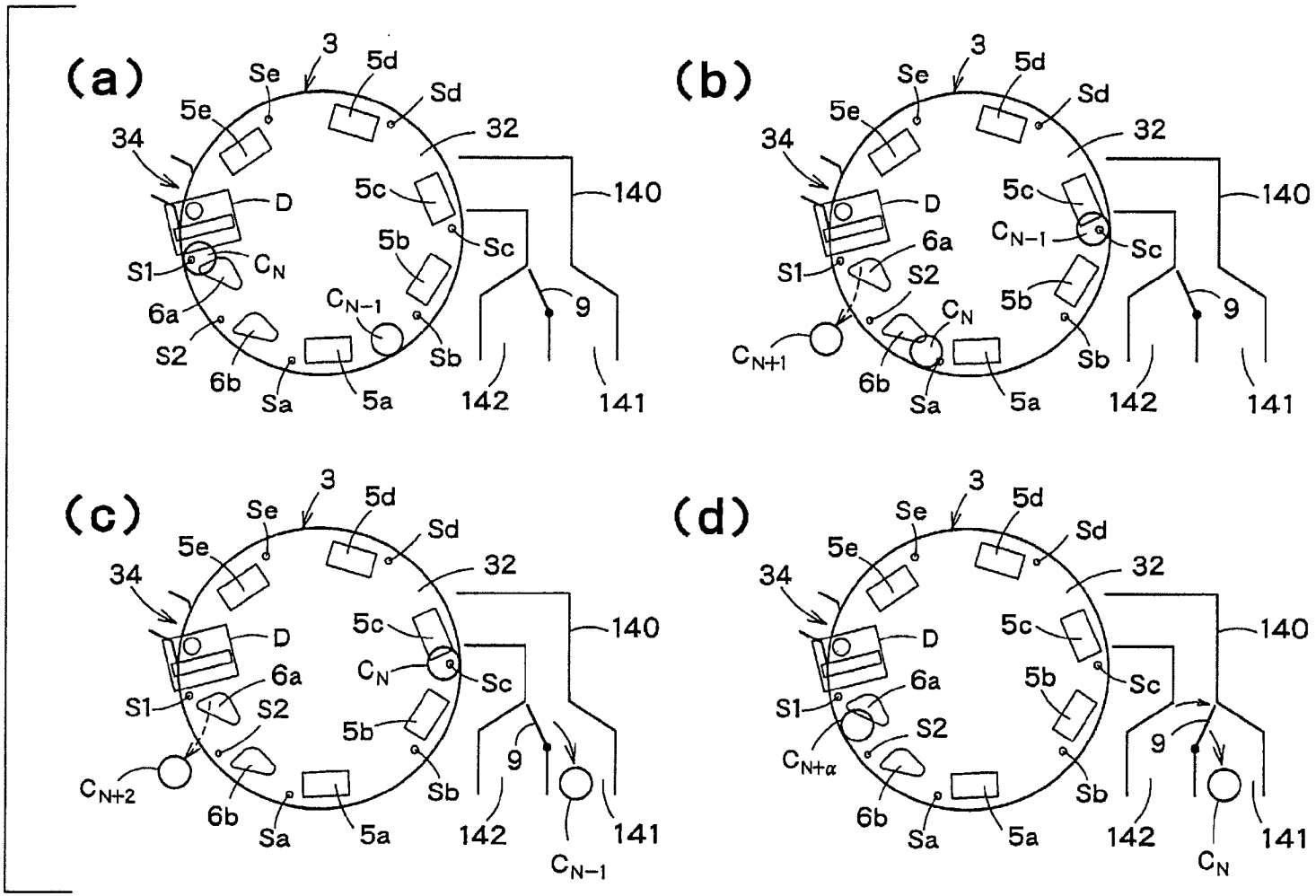
FIG. 11 is a schematic diagram of a configuration and operational sequence associated with route switching in the coin sorting system of FIG. 1, (a) to (d) showing operational states established in that order.

As shown in FIG. 11, a downstream side of the chute 140 associated with the sorting hole 5*c* is branched into a first chute 141 and second chute 142 formed to guide the coins ejected from the sorting hole 5*c* into the first and second temporary storages, respectively. A route-switching mechanism 9 that switches a route of the coins ejected from the sorting hole 5*c* between two chutes 141 and 142 is also provided. The switching mechanism 9 can be constructed of a swing plate provided at the branched section of the chute and a stepping motor that drives the swing plate.

The control unit U (FIG. 1) is configured to conduct the following control in regards to coins to be ejected from the sorting hole 5*c* associated with the switching mechanism 9 (the denomination of the coins in this case is US 5 cent).

(i) The control unit U controls the switching mechanism 9 so as to switch the route of the coins ejected from the sorting hole 5*c* from the first chute 141 to the second chute 142 in appropriate timing to ensure that a last coin $C_N$ as the last one of coins to be received into the first temporary storage enters the first chute 141.

(ii) The control unit U controls the first ejector 6*a* to eject, among coins $C_{N+1}$, $C_{N+2}$, . . . , $C_{N+\alpha}$ following the last coin $C_N$, all coins that have reached the first ejector 6*a* earlier than the route-switching operation of the switching mechanism 9.

Figure 12:
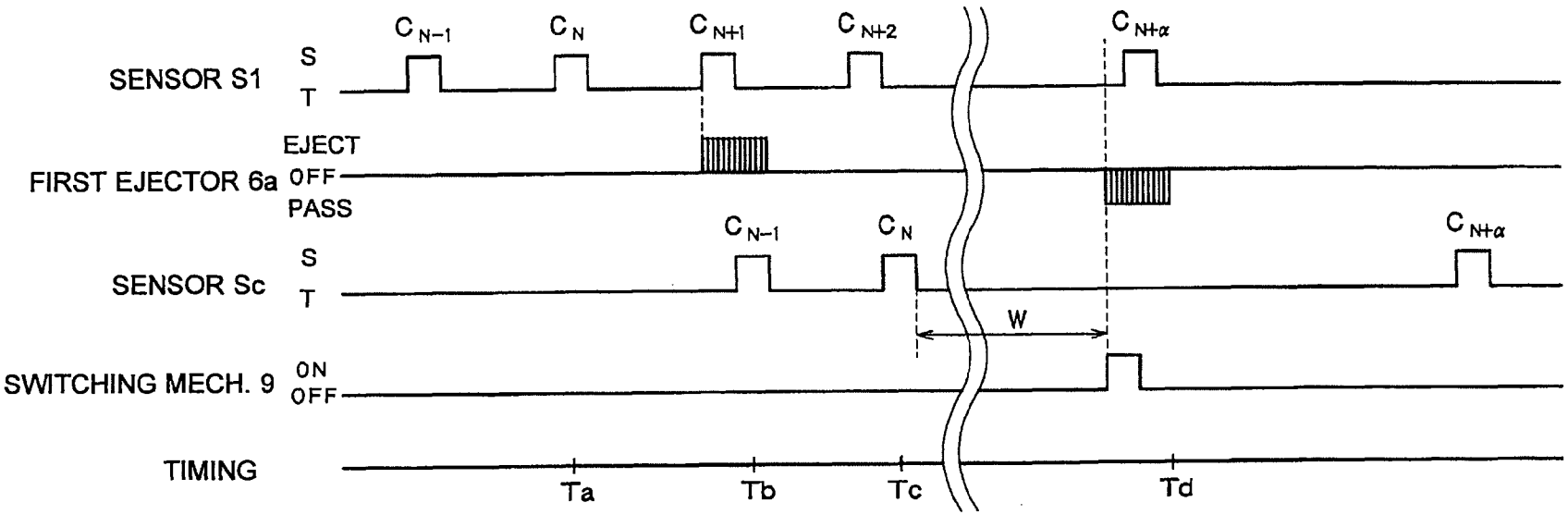
FIG. 12 is a timing chart that shows timings Ta to Td associated with (a) to (d) in FIG. 11, respectively.

More specifically, such operation as shown in FIGS. 11 and 12, for example, is conducted. Timing associated with each of states shown in (a) to (b) of FIG. 11 is denoted by reference symbols Ta to Td in FIG. 12. Detection of an arriving/passing coin by the sensor S1 located immediately before the first ejector 6*a*, switching between the "coin passage position" and "coin ejection position" of the first ejector 6*a*, detection of another passing coin by the sensor Sc located immediately before the ejection hole 5*c*, and route switching by the switching mechanism 9 are shown in FIG. 12. Each of the detection of the passing coins by the sensors S1 and Sc is shown as changes in optical beam transmitting (T)/shielding (S) states of an optical sensor.

In this case, the coins of the associated denomination (US 5 cent) are counted by the control unit U (FIG. 1) on the basis of outputs from the discrimination sensor D and the sensor Sc located immediately before the ejection hole 5*c*. The total number of coins to be collected into the first storage is predetermined as N. the number of coins set according to a capacity of the storage and/or the like. The above "last coin $C_N$ to be collected into the first storage" is therefore the N-th coin.

In FIG. 11(*a*) and the timing Ta of FIG. 12, a preceding coin $C_{N-1}$ immediately preceding the last coin $C_N$ has already moved past the sensor S1 and is heading for the sorting hole 5*c*, and the last coin $C_N$ has been detected by the sensor S1. The route of the coins ejected from the sorting hole 5*c* is preset to the first chute 141.

In FIG. 11(*b*) and the timing Tb of FIG. 12, the preceding coin $C_{N-1}$ has been detected by the sensor Sc, and the last coin $C_N$ has already moved past the sensor S1 and is approaching the sorting hole 5*c*. In addition, at a point of time when the arrival of a following coin $C_{N+1}$ immediately following the last coin $C_N$ is detected by the sensor S1, the ejector 6*a* is switched to the "coin ejection position," and the coin $C_{N+1}$ is ejected by the ejector 6*a*.

In FIG. 11(*c*) and the timing Tc of FIG. 12, the last coin $C_N$ has been detected by the sensor Sc. In addition, another following coin $C_{N+2}$ immediately following the following coin $C_{N+1}$ is ejected by the ejector 6*a* existing at the "coin ejection position." Meanwhile, the preceding coin $C_{N-1}$ has already been ejected from the sorting hole 5*c* and entered the first chute 141. This coin will be collected into the first temporary storage.

Next during a time interval from the timing Tc to the timing Td in FIG. 12, coin route switching from the first chute 141 to the second chute 142 by the switching mechanism 9 is conducted at a point of time when a certain waiting time W elapses from the passage detection of the last coin $C_N$ by the sensor Sc. Based on simulation, experimentation, and/or the like, the waiting time W is preset to ensure that such route switching by the switching mechanism 9 is conducted in appropriate timing for the last coin $C_N$ to enter the chute 141. The switching of the ejector 6*a* to the "coin passage position" also occurs concurrently with the elapse of the waiting time W.

In this way, in FIG. 11(*d*) and the timing Td of FIG. 12 that follows route switching by the switching mechanism 9, the last coin $C_N$ has already finished entering the first chute 141, and this coin will be collected into the first storage. In addition, yet another following coin $C_{N+\alpha}$ that has reached the first ejector 6*a* following the end of route switching by the switching mechanism 9 moves past the ejector 6*a* without being ejected thereby. After that, the following coin $C_{N+\alpha}$ is ejected from the sorting hole 5*c*, then enters the second chute 142, and is collected into the second temporary storage. All coins following the coin $C_{N+\alpha}$ will be ejected and collected in the same way as the coin $C_{N+\alpha}$.

Effects

Next, advantageous effects of the present embodiment constructed above are described below.

According to the present embodiment, the rolling-coin passageway 7 (FIGS. 6 and 8) that extends aslope to cause the coins to roll under the respective own weights renders the coins transferable from the feed unit A to the sorting unit B without undergoing any restraints. Thus, practically no jam with deformed or other coins is likely to occur during coin transfer. In addition, even if such jam occurs, the jam can be cleared by easily removing the jam-causing coins (by hand or using the ejector 76) without even having to free the coins from restraint.

In this case, the coin Cd (FIG. 8) deformed to such an extent that the edge thereof deviates from the ledge surface while rolling along the rolling-coin passageway 7 is not supported by the ledge surface 72 and therefore slides down from the passageway 7. This makes it possible to automatically eliminate such deformed coins Cd before them entering the sorting unit B.

In addition, if the discrimination sensor D (FIGS. 1 and 6) provided on the conveying passageway 32 of the sorting unit B is an image sensor that recognizes an image of the coin or a magnetic sensor that recognizes the diameter of the coin, the recognition can be conducted more stably than in a case where an equivalent sensor is provided on the rolling-coin passageway 7 that does not restrain coins. In that case, since the conveyor disc 4 has a resilient member 44 (FIG. 3) facing the conveying passageway 32 of the sorting member 3, the coin can be recognized even more stably and reliably while being resiliently pressed against the sensor D.

Furthermore, the large-coin ejection structure 15, 17*b*, 19*b* (FIG. 7) of the feed unit A makes it possible to eliminate beforehand the large coins C1 not to be sorted by the sorting unit B.

Since the foregoing chutes 144 and 146 and the common reject box 114 have the configurations described above, the large coins C1 ejected from the sorting unit A, the slid-down coin Cs that has slid down from the rolling-coin passageway 7, and the reject coins (ejected coins) Cr ejected from the sorting unit B can be collected into the reject box 114 and directly removed to outside the system, as shown in FIG. 2. Additionally, separating the inside of the reject box 114 by the partition 114*c* makes it possible to collect the large and the slid-down coins C1 and Cs, and the reject coins Cr into the common reject box 114 and then remove each of the coins separately from each other, as shown in FIG. 2.

Next in the feed unit A, as shown in FIG. 2, the planar upper face of the feed disc 2 is inclined relative to the horizontal plane, and as shown in FIG. 7, the coin-entrance 11 facing the lower section of the coin inlet opening 1*a* is formed at the bottom face 16 of the guide member 1 opposed to the upper face of the feed disc 2. Thus, each coin that has been loaded into the inlet opening 1*a* can be introduced from the entrance 11 into the space between the guide member 1 and the feed disc 2 by utilizing gravitational force, so the coin can be introduced more stably and more reliably than by exclusively using centrifugal force.

In addition, any coins and foreign substances dwelling between the guide member 1 and the feed disc 2 can slide down along the planar upper face of the disc 2 to be ejected therefrom, by temporarily separating the guide member 1 from the disc 2 by use of the separator 8 (FIG. 2). In this case, the coins and the foreign substances are collected into the first compartment 114*a* of the reject box 114 through the chute 144.

Next, in the sorting unit B, the advantageous effects below can be obtained in regard to at least one of the sorting holes 5*a* to 5*e* to which the pair of first and second storages 130 and 130 are assigned. That is to say, the switching mechanism 9 can switch the chute (coin route) between 141 and 142 to ensure that after the number of coins in the first storage 130 has reached the preset number N, other coins can be collected into the second storage 130, without stopping the introduction of the coins from the inlet 34, as shown in FIG. 11. In that case, among coins $C_{N+1}, C_{N+2}, \ldots, C_{N+\alpha}$ following the last coin $C_N$ corresponding to the preset number N, only coins that reached the first ejector 6*a* earlier than the above route-switching operation of the switching mechanism 9 are, as shown in FIG. 2, collected into the reject box 114 (the second compartment 114*b*) applicable to the reject coins Cr, and these collected coins are each placed in a state that allows direct removal of the coin from the reject box 114.

Modifications (1) The configuration of the guide member 1 in the feed unit A is not limited to the above-described configuration provided that coins are fed one by one with the rotation of the feed disc 2. For example, if there is no need to sort out and eject the large coins C1 in the feed unit A, the large-coin ejection structures 15, 17*b*, and 19*b* may be omitted.

(2) The detailed configuration of the first and second ejectors 6*a* and 6*b* in the feed unit B is not limited to the above-described configuration (FIGS. 6, 9, and 10) and can be of a type that allows arbitrary ejection of coins according to discrimination results based on the output from the discrimination sensor D.

(3) The configuration of the multiple sorting devices in the sorting unit B that are configured to selectively eject coins is not limited to the combination (FIG. 6) of the first and second ejectors 6*a* and 6*b* and the plurality of sorting holes 5*a* to 5*e*. For example, all the sorting holes 5*a* to 5*e* may be replaced by the same number of ejectors similar in type to the ejectors 6*a* and 6*b*, or part of the sorting holes 5*a* to 5*e* may be replaced by an ejector(s) of a kind similar to that of ejectors 6*a* and 6*b*.

Furthermore, either sorting hole 5*a* to 5*e* may be replaced by another sorting structure that ejects coins of particular denominations (for example, a structure that ejects coins of particular denominations from the sorting member 3 in a radially outer direction of the sorting member).

(4) The reject box 114 (FIG. 2) may have partitions for receiving the large coins C1, the slid-down coins Cs, and the reject coins Cr separately from one another (that is, partitions for forming three compartments). In that case, the large coins C1, the slid-down coins Cs, and the reject coins Cr can be collected into the common reject box 114, and then the three kinds of coins can each be removed separately from one another.

(5) Alternatively, the reject box 114 may be used for the reject coins Cr only, and an ejected-coin receiving unit for receiving the large coins C1 and the slid-down coins Cs in such a form as to make these coins directly removable to the outside may be provided separately from the reject box 114. In that case, a partition should preferably be provided in that receiving unit to receive the large coins C1 and the slid-down coins Cs separately from each other. This allows the large coins C1 and the slid-down coins Cs to be collected into the common receiving unit other than the reject box 114 and thereafter be-removed separately from each other.

(6) The case has been described in which the reject box 114 that can be pulled out forward is used as a (first) ejected-coin receiving unit that receives coins with the coins directly removable to outside the system, but this does not limit the present invention. For example, a receiving unit of a form such as a container with a door, lid or cover openable/closable from outside or an outwardly opened tray may also be used instead.

(7) The case has been described in which all coins that have reached the first ejector 6*a* earlier than route switching by the switching mechanism 9 are ejected by the first ejector 6*a*, but this does not limit the present invention. That is to say, all coins that have reached the second ejector 6*b* earlier than route switching by the switching mechanism 9 may be ejected by the second ejector 6*b*. In addition, ejection by the first ejector 6*a* and ejection by the second ejector 6*b* may be used separately according to particular requirements.

What is claimed is:

1. A coin sorting device, comprising:

a sorting member that includes a1) a coin conveying passageway with an inlet through which coins are introduced one by one, a2) a plurality of sorting structures spacedly arranged along the conveying passageway, each of the sorting structures being configured to eject coins of a particular denomination, a3) a discrimination sensor for discriminating the coins, disposed between the inlet and the upstream-most sorting structure on the conveying passageway, and a4) an ejection mechanism disposed between the discrimination sensor and the upstream-most sorting structure on the conveying passageway, the ejection mechanism being configured to selectively eject the coins;

a conveyor member that conveys the coins along the conveying passageway of the sorting member;

at least one pair of first and second sorted-coin receiving units assigned to one of the sorting structures;

at least one pair of first and second chutes through which the coins ejected from the associated sorting structure are guided into the first and second receiving units in the associated pair of receiving units, respectively;

a route-switching mechanism configured to switch a route of the coins ejected from the associated sorting structure between the first and second chutes in the pair of chutes; and a control unit configured to discriminate the coins on the basis of outputs from the discrimination sensor, and to control the ejection mechanism and the switching mechanism according to discrimination results thereof, the control unit being further configured, for the coins of a denomination to be ejected by the associated sorting structure associated with the switching mechanism, to:

b1) control the switching mechanism to switch the route of the coins ejected from the associated sorting structure from the first chute to the second chute in appropriate timing to ensure that a predetermined last coin to be received into the first receiving unit enters the first chute; and b2) control the ejection mechanism to eject all coins of the denomination to be ejected by the associated sorting structure that follow the predetermined last coin that reach the ejection mechanism earlier than the route-switching operation of the switching mechanism.

2. The coin sorting device according to claim 1, further comprising an ejected-coin receiving unit that receives the coins ejected by the ejection mechanism with the coins directly removable to outside the sorting device;

wherein the control unit is further configured to control the ejection mechanism to eject reject coins whose discrimination results based on outputs from the discrimination sensor are abnormal.

3. A coin sorting device, comprising:

a sorting member that includes a1) a coin conveying passageway with an inlet thorough which coins are introduced one by one, a2) a plurality of sorting structures spacedly arranged along the conveying passageway, each of the sorting structures being configured to eject coins of a particular denomination, a3) a discrimination sensor for discriminating coins, disposed between the inlet and the upstream-most sorting structure on the conveying passageway, and a4) first and second ejection mechanisms spacedly arranged along the conveying passageway between the discrimination sensor and the upstream-most sorting structure, each of the ejection mechanisms being configured to selectively eject the coins;

a conveyor member that conveys the coins along the conveying passageway of the sorting member;

at least one pair of first and second sorted-coin receiving units assigned to one of the sorting structures;

at least one pair of first and second chutes through which the coins ejected from the associated sorting structure are guided into the first and second receiving units in the associated pair of receiving units, respectively;

a route-switching mechanism configured to switch a route of the coins ejected from the associated sorting structure between the first and second chutes in the pair of chutes;

a first ejected-coin receiving unit that receives the coins ejected by the first ejection mechanism;

a second ejected-coin receiving unit that receives the coins ejected by the second ejection mechanism; and a control unit configured to discriminate the coins on the basis of outputs from the discrimination sensor, and to control the first and second ejection mechanisms and the switching mechanism according to discrimination results thereof, the control unit being further configured to:

c1) control the first ejection mechanism to eject reject coins whose discrimination results based on outputs from the discrimination sensor are abnormal;

c2) control the second ejection mechanism to eject the coins of a particular denomination according to particular requirements; and c3) for the coins of a denomination to be ejected by the associated sorting structure associated with the switching mechanism, c31) control the switching mechanism to switch the route of the coins ejected from the associated sorting structure from the first chute to the second chute in appropriate timing to ensure that a predetermined last coin to be received into the first receiving unit enters the first chute, and c32) control the first ejection mechanism and/or second ejection mechanism to eject all coins of the denomination to be ejected by the associated sorting structure that follow the predetermined last coin that reach the first ejection mechanism and/or second ejection mechanism earlier than the route-switching operation of the switching mechanism.

* * * * *